US006682460B2

(12) United States Patent
Lo et al.

(10) Patent No.: US 6,682,460 B2
(45) Date of Patent: Jan. 27, 2004

(54) TREADMILL WITH FOLDABLE SUPPORT UNIT

(75) Inventors: Peter K. C. Lo, No. 5, Ching-Cheng 4th St., Taichung City (TW); Pendy Liao, Taichung (TW)

(73) Assignee: Peter K. C. Lo, Taichung (TW)

( * ) Notice: Subject to any disclaimer, the term of this patent is extended or adjusted under 35 U.S.C. 154(b) by 317 days.

(21) Appl. No.: 09/947,143

(22) Filed: Sep. 4, 2001

(65) Prior Publication Data

US 2003/0060334 A1 Mar. 27, 2003

(51) Int. Cl.[7] ..... A63B 22/02
(52) U.S. Cl. ..... 482/54
(58) Field of Search ..... 482/51, 54, 908

(56) References Cited

U.S. PATENT DOCUMENTS 5,676,624 A * 10/1997 Watterson et al. ..... 482/54
5,772,560 A 6/1998 Watterson et al.
6,077,200 A * 6/2000 Lin ..... 482/54
6,325,745 B1 * 12/2001 Yu ..... 482/54
6,398,696 B1 * 6/2002 Tsou ..... 482/54

* cited by examiner

*Primary Examiner*—Stephen R. Crow
(74) *Attorney, Agent, or Firm*—Knobbe, Martens, Olson & Bear, LLP

(57) ABSTRACT

A treadmill includes a tread base with a first foot unit disposed at a front end of the tread base, and a pair of rear links having front ends pivotally connected to the tread base rearwardly of the first foot unit and rear ends provided with a second foot unit. The rear links are pivotal relative to the tread base to move the second foot unit towards and away from the tread base. A console assembly includes a pair of posts extending upward from and pivoted to the tread base, and a console panel attached to top ends of the posts. A pair of coupling arms have front and rear ends respectively connected to the posts and the rear links.

10 Claims, 16 Drawing Sheets

TREADMILL WITH FOLDABLE SUPPORT UNIT

BACKROUND OF THE INVENTION

1. Field of the Invention

This invention relates to a treadmill, and more particularly to a foldable treadmill which can be folded to an inoperative position and unfolded to an operative position ready for a user to exercise thereon.

2. Description of the Related Prior Art

Typical reorienting treadmills having a tread base that is rotatably attached to a support structure and orientable from a first position for performing exercises to a second position for storage, are disclosed in U.S. Pat. No. 5,772,560 (Watterson) and U.S. Pat. No. 5,676,524 (Watterson). U.S. Pat. No. 5,772,560 shows a treadmill (FIGS. 1 and 2) that includes a tread base 100 and a support structure 200. The support structure 200 has feet means and an upright structure extending upwardly from the feet means. The front portion of the tread base 100 is rotatably connected to the support structure 200 to rotate about an axis, so that the tread base 100 can be oriented from a first position ready for a user to perform exercises (see FIG. 1), to a second position for storing the treadmill (see FIG. 2).

The aforementioned treadmill, though having the function of rotating the tread base about an axis so as to reorient the same from a folded position to an unfolded position, has the following drawbacks:

1. Since the tread base 100 is pivoted to the upright structure of the support structure 200 rather than the feet means and since the pivot axis thereof is at a height distant from the supporting surface so as to allow free rotation of the tread base, the center of gravity of the tread base 100 can not be lowered. If one tries to lower the pivotal axis of the tread base 100, the front end of the tread base 100 can interfere with the floor surface and rotation of the tread base 100 to a vertical position will become impossible.
2. Since the weight of the tread base 100 is borne by the upright structure at the pivot joint thereof either at the folded position or the unfolded position of the treadmill, the treadmill is prone to wear at the pivot joint of the tread base 100 and the support structure 200. A strong structural material is needed for the pivot joint and the upright structure in order to bear the weight of the tread base 100 and to bear the dynamic forces produced during the exercise action of the user.
3. As can be understood from FIG. 2, the treadmill has to be tilted to an angle so as to raise the rear ends of the feet means and to place rollers 201 mounted at the front ends of the feet means in contact with the supporting floor when the folded treadmill is to be moved from one place to another. This is laborious and inconvenient.

SUMMARY OF THE INVENTION

An object of the invention is to provide a foldable treadmill which can address the problems described hereinabove.

Another object of the invention is to provide a tread mill with a stable foldable support structure to support a tread base.

According to the present invention, a treadmill which can be folded to an inoperative position and unfolded to an operative position, comprises a tread base having a front end, and a first foot unit disposed at the front end; and a pair of rear links having front ends pivotally connected to the tread base about a first pivot axis posterior to the first foot unit, and rear ends provided with a second foot unit. The rear links are pivotal relative to the tread base to move the second foot unit towards the tread base when the treadmill is at the operative position and away from the tread base when the treadmill is at the inoperative position. The treadmill further comprises: a console assembly including a pair of posts extending upward from the tread base adjacent the front end of the tread base and pivoted to the tread base respectively at left and right sides of the tread base about a second pivot axis, and a console panel attached to top ends of the posts; and a pair of coupling arms having front ends respectively connected to the posts and rear ends respectively connected to the rear links between the front and rear ends of the rear links.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
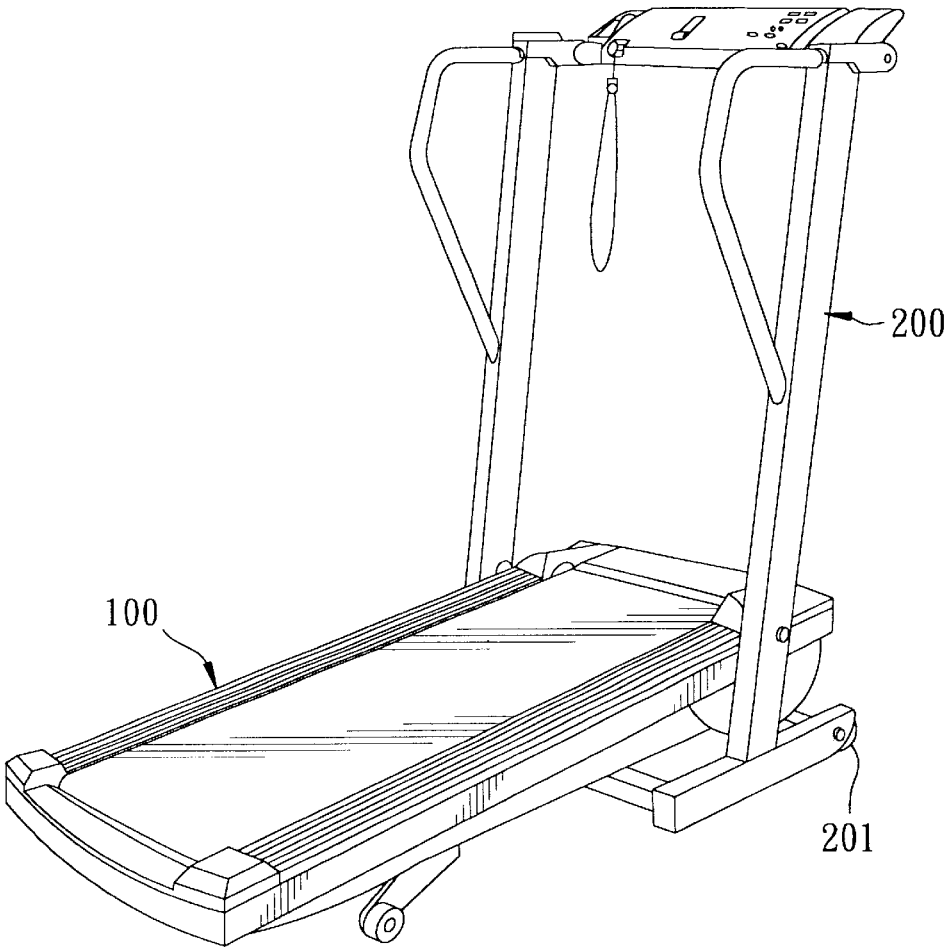
FIG. 1 PRIOR ART
FIG. 1 is a perspective view of a conventional treadmill at an unfolded operative position.
Figure 2:
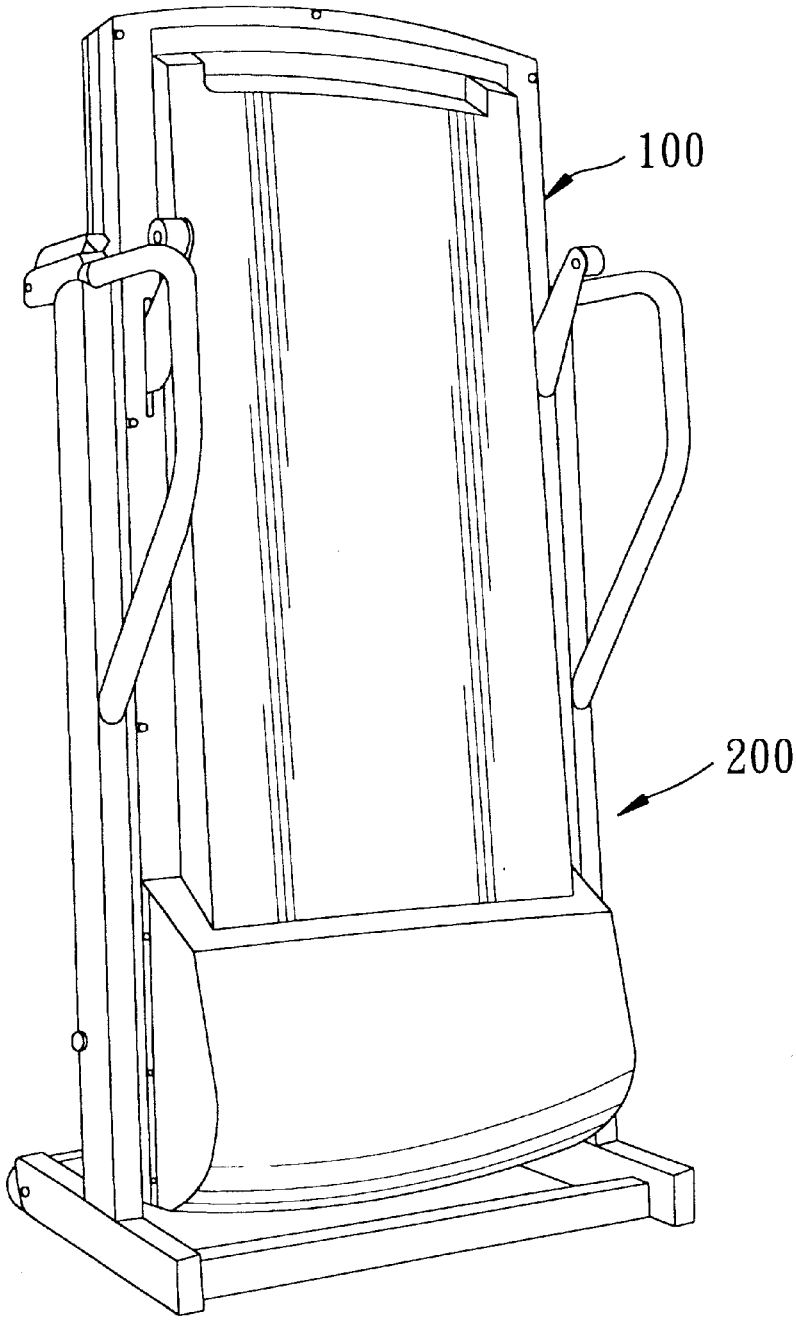
FIG. 2 PRIOR ART
FIG. 2 is a perspective view of the treadmill of FIG. 1 at a folded inoperative position.

Referring initially to FIGS. 3 to 7, the treadmill 1 of the first embodiment of the present invention is shown to include a tread base 10 for carrying an endless belt (not shown). The tread base 10 has left and right sides 11, 12, a front end 13, a rear end 14, a pair of rollers 112 and 122 provided near the rear end 14 of the tread base 10, and a deck 16 covering the front portion of the tread base 10.

Figure 4:
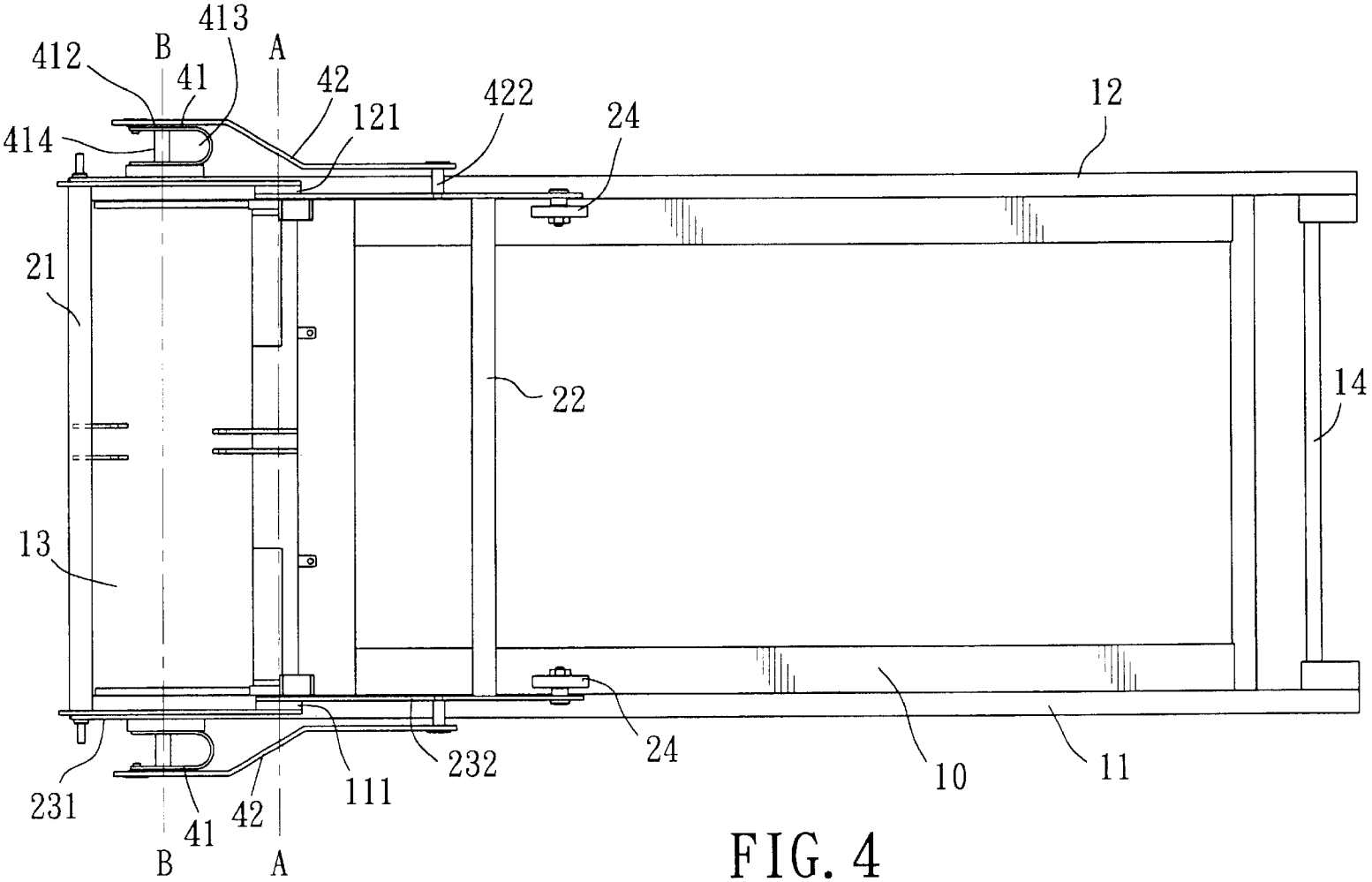
FIG. 4 is a bottom view of the treadmill of FIG. 3 but with a portion thereof being removed for the sake of clarity.
Figure 6:
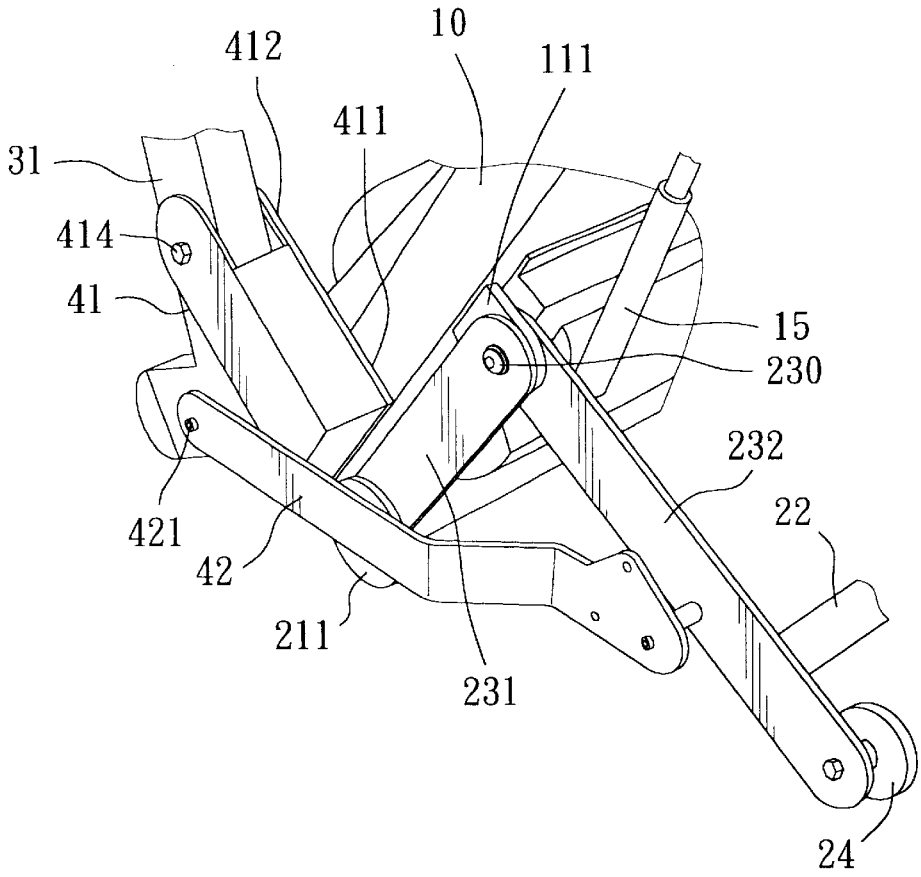
FIG. 6 is a fragmentary perspective view of the treadmill of FIG. 3.

As best shown in FIGS. 4 and 6, a pair of pivot supports in the form of straps 111, 121 are respectively welded to the left and right sides of the tread base 10 near the front end 13 and project downward from the tread base 10. A first foot unit provided at the front end of the tread base 10 includes a pair of front links 231 mounted on the tread base 10 by pivotally connecting rear ends of the front links 231 to the respective straps 111, 121 of the tread base 10 via pivot members 230 (only one is shown in FIG. 6) which define a first pivot axis (A). The front links 231 have foot bottoms formed as first rollers 211 which are respectively attached to the front ends of the front links 231. The front links 231 are interconnected by a transverse rod 21 near the front ends of the front links 231. The front links 232 are movable toward and away from the tread base 10 via a pivotal movement of the front links 231 and can be retained in a desired position via a retention unit 50 which interconnects the transverse rod 21 and the tread base 10.

Figure 7:
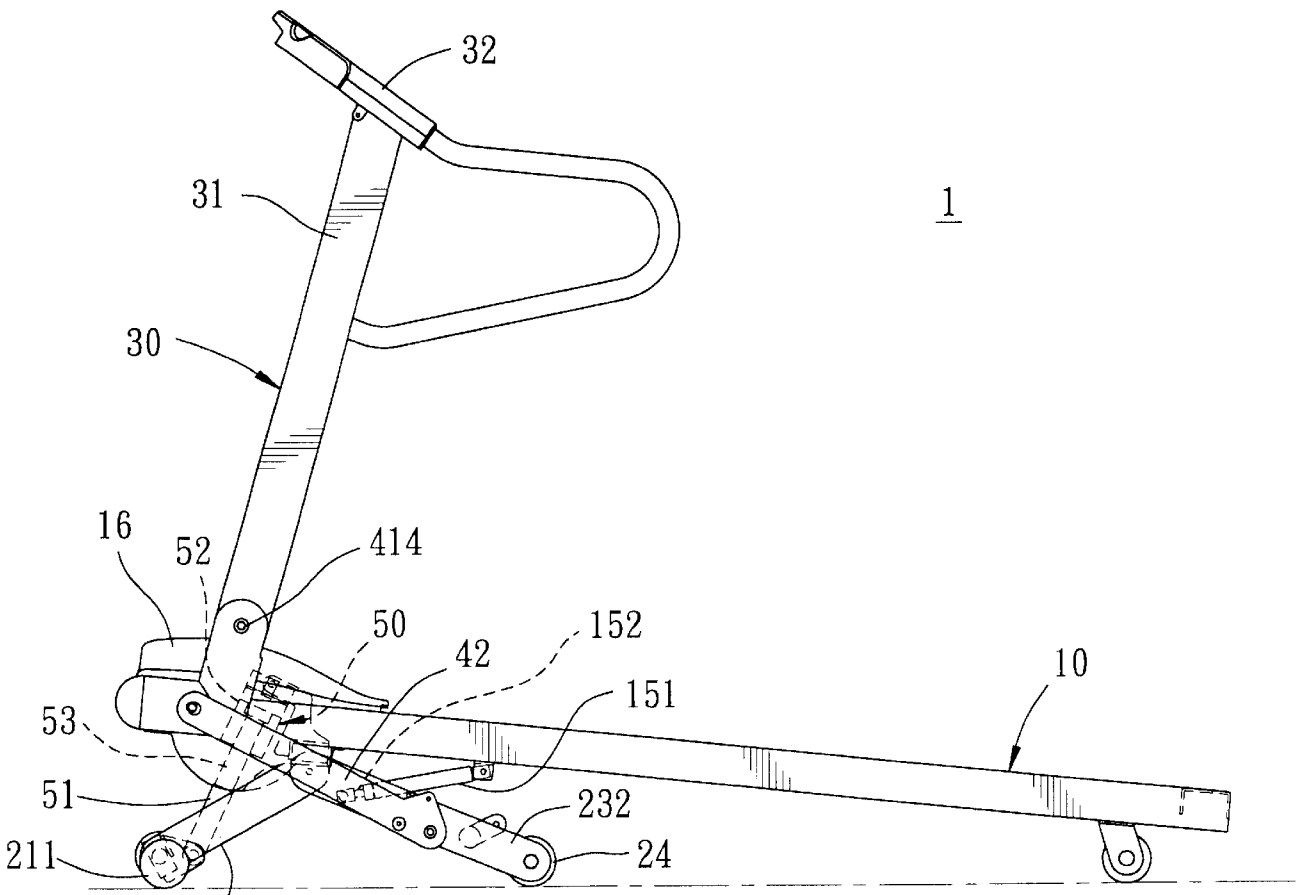
FIG. 7 is a schematic side view of the treadmill of FIG. 3 in an inclined position.

As best shown in FIG. 7, the retention unit 50 includes an internally threaded tube 51 mounted on the transverse rod 21 of the front links 231, a threaded rod 53 inserted threadedly into the tube 51, and a driving unit 52 mounted on the tread base 10 and coupled operably to the rod 53 for driving the latter to thread into or extend out of the tube 51. The extension of the rod 53 will move the front links 231 away from the tread base 10, thereby raising the front end of the tread base 10 and placing the tread base 10 in an inclined position. The retraction of the rod 53 into the tube 51 will place the front links 231 in the proximity of the bottom side of the tread base 10.

A pair of rear links 232 are mounted on the tread base 10 by connecting pivotally the front ends of the rear links 232 to the respective straps 111, 121 via the pivot members 230. Second rollers 24 are respectively attached to the rear ends of the rear link 232 to serve as a second foot unit. A transverse rod 22 interconnects the rear links 232 near the rear ends of the rear links 232.

Figure 5:
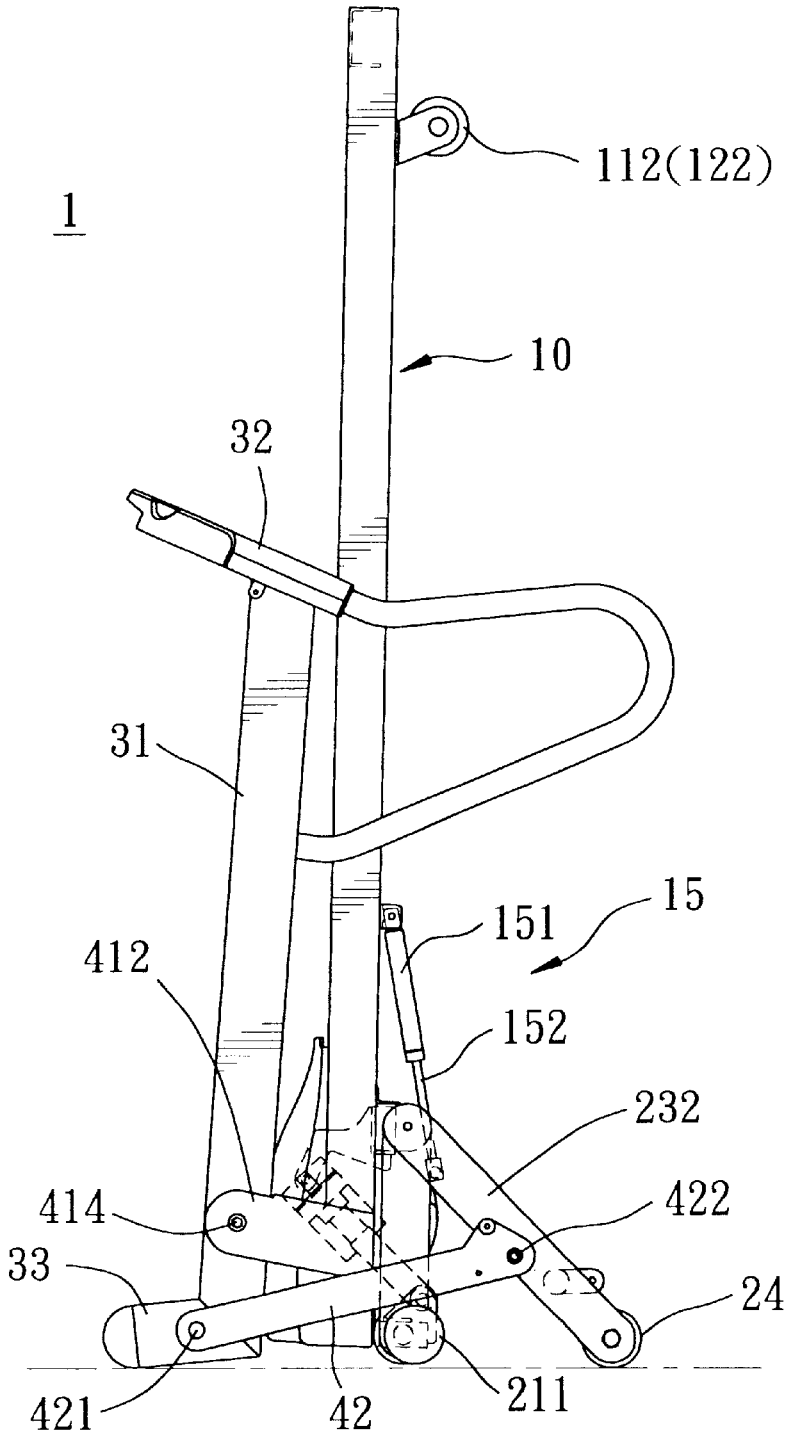
FIG. 5 is a side view of the treadmill of FIG. 3 in a folded position.

A console assembly 30 includes left and right posts 31 extending upward from the front portion of the tread base 10, and a console panel 32 attached to the top ends of the posts 31. As best seen in FIGS. 5 and 6, the bottom ends of the posts 31 are formed as blocks 33 which extend forwardly to serve as a third foot unit when the tread base 10 is at a folded position.

Pivot bearings 41 are respectively secured to the left and right sides of the tread base 10 to serve as a support for pivotally mounting the posts 31 on the tread base 10. As best shown in FIGS. 4 and 6, each pivot bearing 41 has a U-shaped socket 413 with a forwardly facing opening, and includes a mounting section 411 adjacent the tread base 10 and a pivot section 412 extending upwardly from the mounting section 411. Each pivot bearing 41 receives the bottom end of one of the posts 31 in the U-shaped socket 413 and is fixed to the tread base 10 by welding the mounting section 411 to the tread base 10. Pivot bolts or pins 414 are respectively attached to the pivot sections 412 to pivotally connect the bottom ends of the posts 31 to the respective pivot bearings 41, thereby defining a second pivot axis (B) at a level above the tread base 10. The third foot unit or the blocks 33 are situated below the second pivot axis (B) and above the first rollers 211 when the treadmill 1 is at the operative position.

The treadmill 1 further includes a pair of coupling arms 42 for connecting the posts 31 to the rear links 232, respectively. Each coupling arm 42 has a front end connected to the block 33 of the corresponding post 31 with a bolt or pin 421. The rear end of the coupling arm 42 is pivoted to the corresponding rear link 232 via a bolt or pin 422 between the front and rear ends of the rear link 232.

Figure 3:
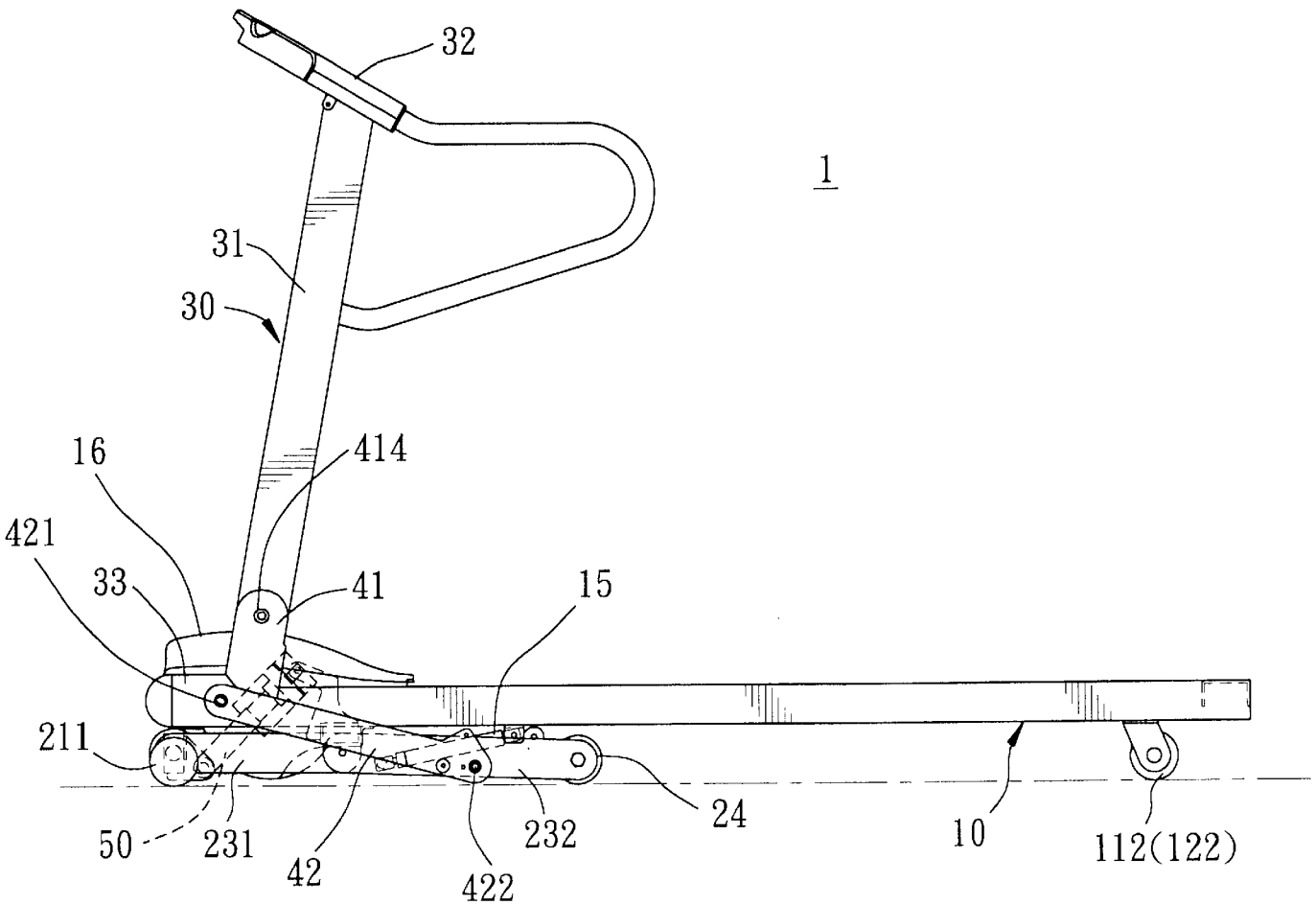
FIG. 3 is a schematic side view of a first embodiment of the present invention in an unfolded operative position.

As shown in FIGS. 3, 5 and 7, the tread base 10 is further provided with a lift unit 15 of the conventional type which is composed of a pneumatic cylinder 151 and a piston rod 152. The lift unit 15 is disposed between the tread base 10 and the rear links 232 and interconnects the same. The lift unit 15 is extendible to move the rear links 232 away from the tread base 10 and is retractable to move the rear links 232 towards the tread base 10.

With the configuration described above, when the tread base 10 is to be oriented into a folded inoperative position for storage, one must start with lifting the tread base 10 from its rear end 14 via manual operation. As the tread base 10 is lifted, the rear end 14 of the tread base 10 moves toward the console assembly 30, and the ends of the coupling arms 42, connected to the rear links 232, pull forward the rear links 232. Meanwhile, the lift unit 15 operates to rotate further the tread base 10 until the tread base 10 reaches its folded position as shown in FIG. 5.

At the folded position, the tread base 10 is substantially vertical to the floor, the front links 231 and the rear links 232 form an acute angle therebetween, and the distance between the front ends of the front links 231 and the rear ends of the rear links 232 becomes smaller than that when the tread base 10 is at the unfolded position. On the other hand, the blocks 33 extending at the bottom ends of the posts 31 are lowered to the floor and rest on the floor in front of the first and second rollers 211, 24. As such, the blocks 33 together with the first and second rollers 211, 24 provide a stable support for the tread base 10. The lift unit 15 also provides a supporting function to avoid accidental turn-over of the tread base 10.

When the rear end 14 of the tread base 10 moves downward, the ends of the coupling arms 42, connected to the rear links 232, are lowered, thereby forcing the second rollers 24 of the rear links 232 to move backward. The rear links 232 stretch out until they lie substantially in a horizontal position and in alignment with the respective front links 231. At this stage, the front and rear links 231, 232 together with the first and second roller units 211, 24 are immediately below the tread base 10 and the center of gravity of the tread base 10 is kept to a minimum height.

Figure 8:
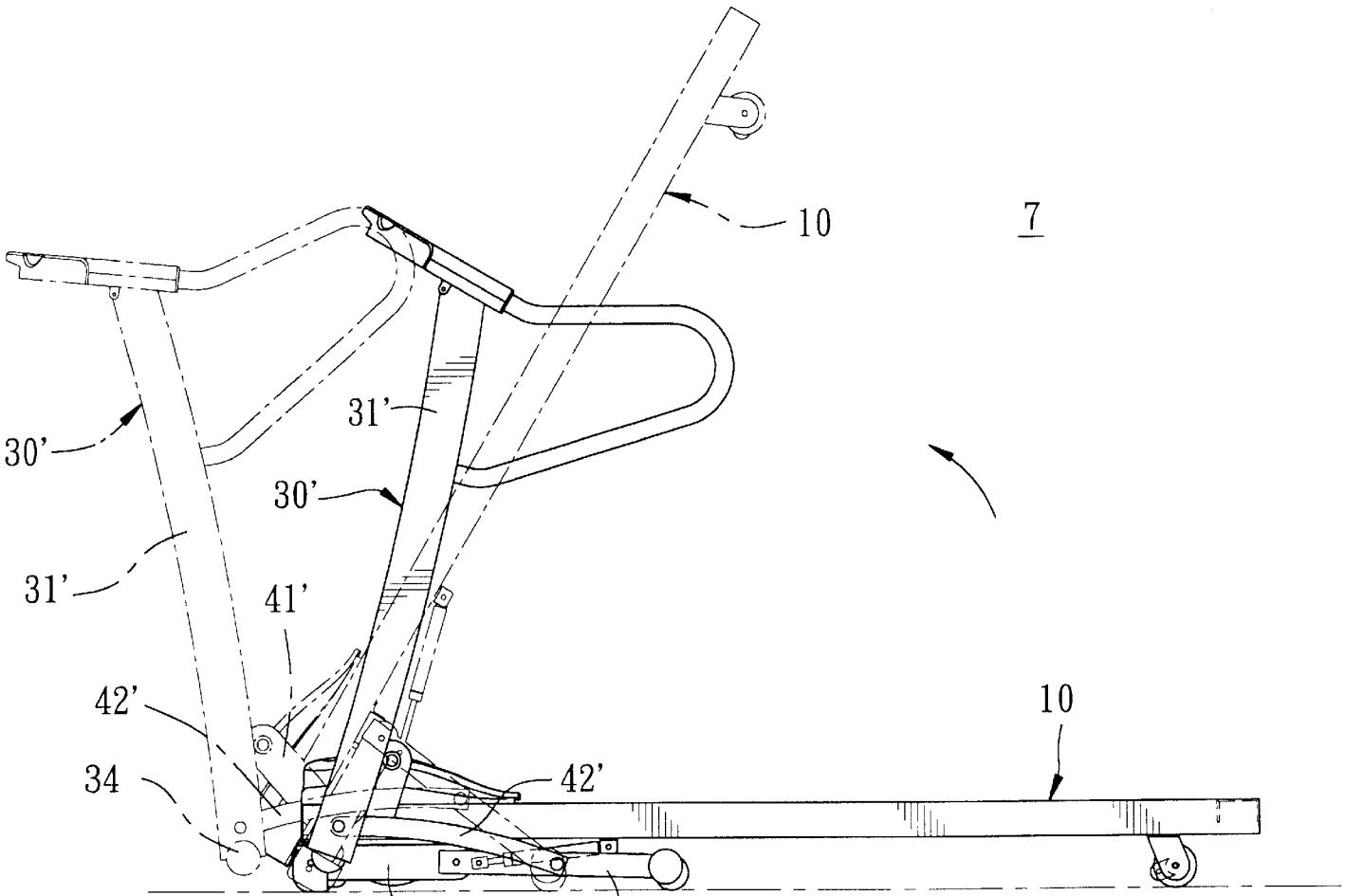
FIG. 8 is a schematic side view of a second embodiment of the present invention in an unfolded operative position.
Figure 9:
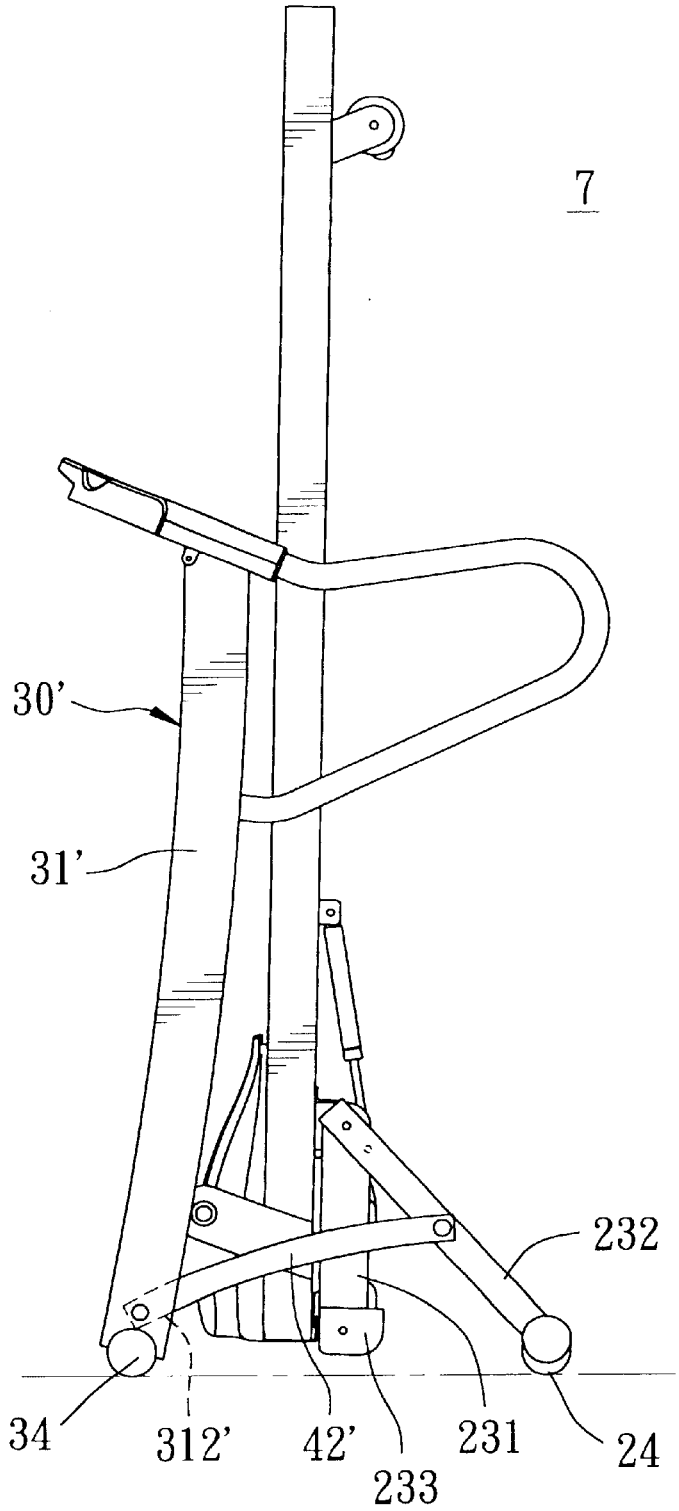
FIG. 9 is a schematic side view of the treadmill of FIG. 8 in a folded inoperative position.
Figure 10:
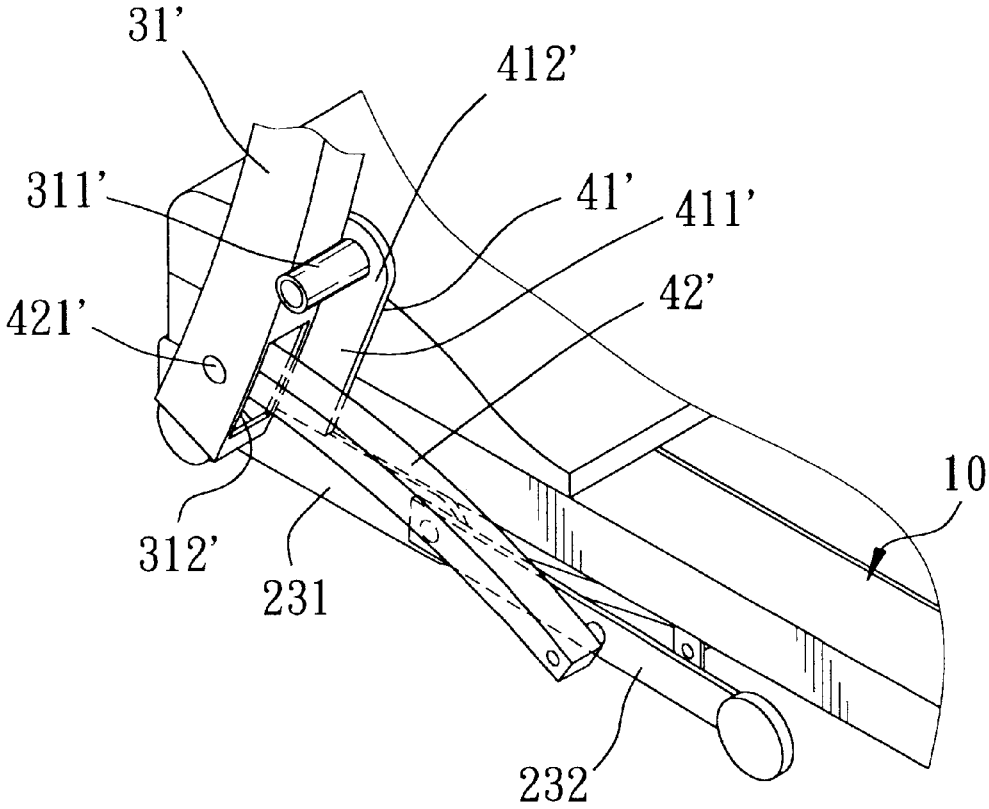
FIG. 10 is a fragmentary perspective view of the treadmill of FIG. 8.
Figure 11:
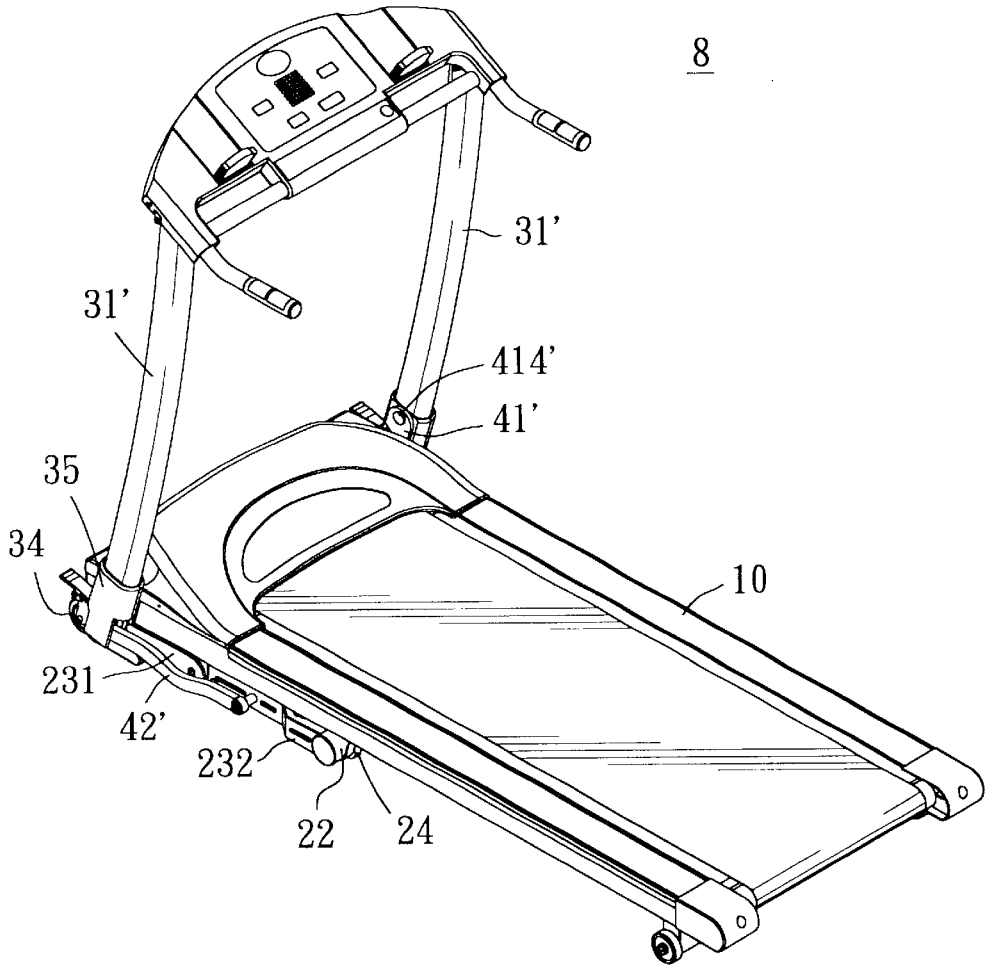
FIG. 11 is a perspective view of a third embodiment of the present invention in an unfolded position.
Figure 12:
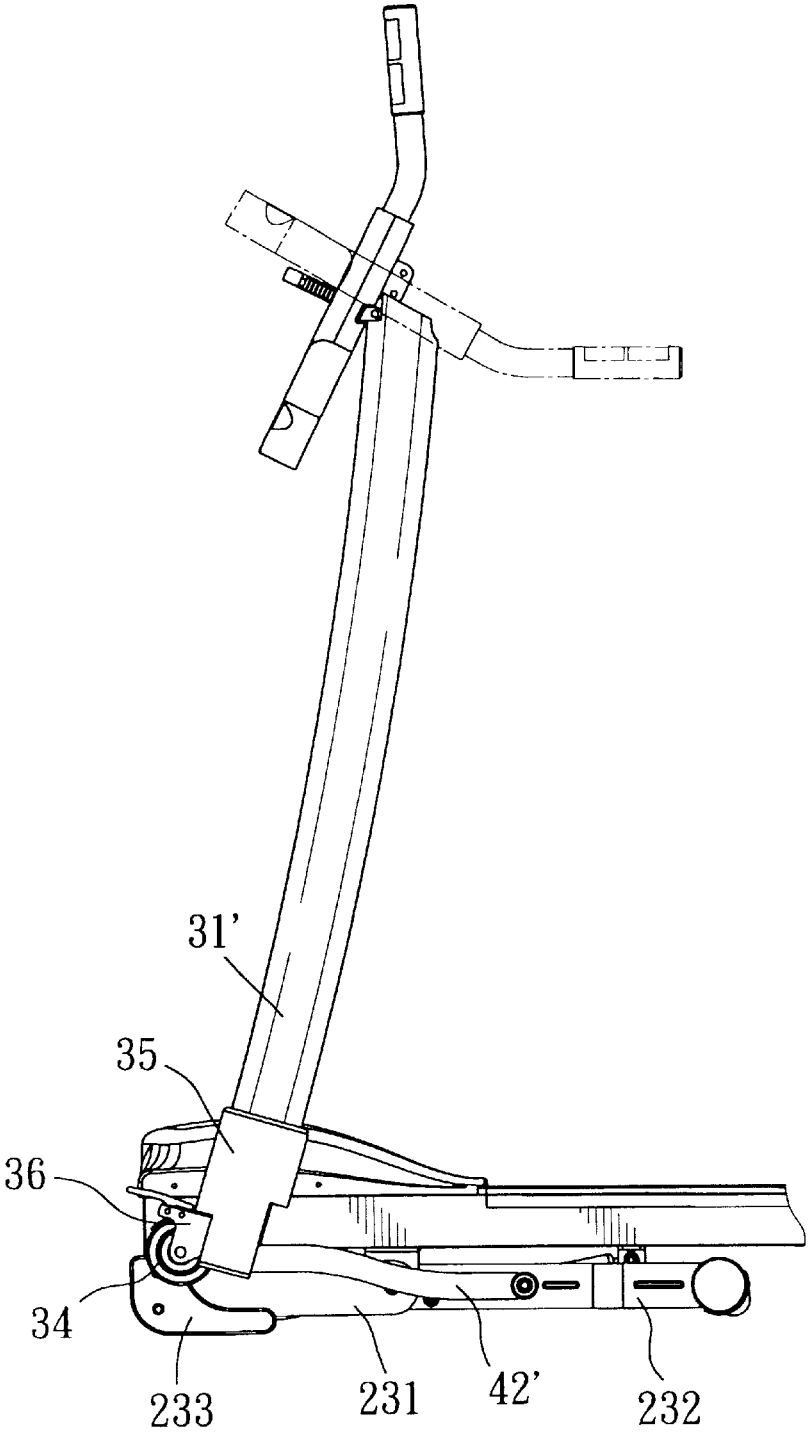
FIG. 12 is a schematic side view of the front portion of the treadmill of FIG. 11.
Figure 13:
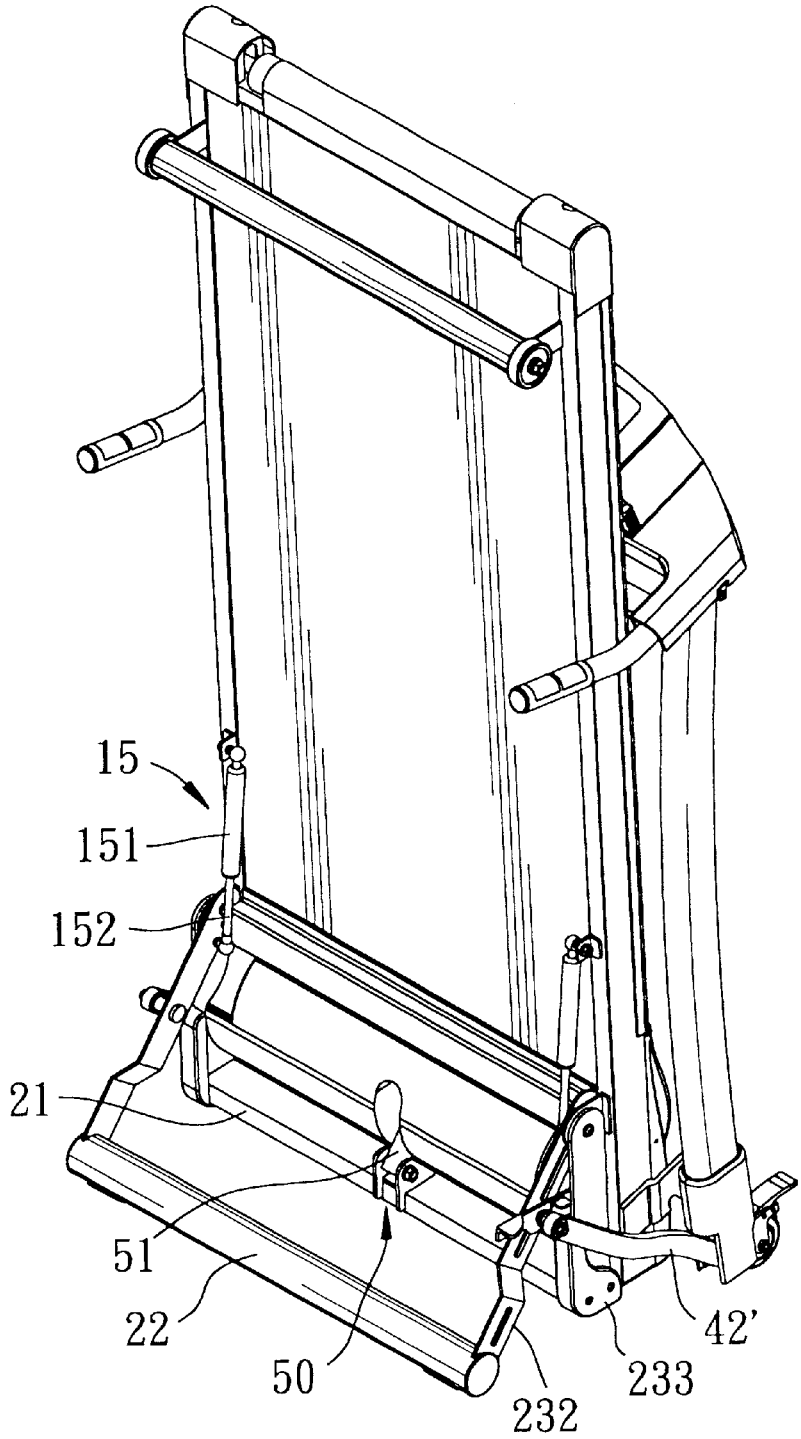
FIG. 13 is a perspective view of the treadmill of FIG. 11 in a folded position.

FIGS. 8 to 10 illustrate a second preferred embodiment of the present invention. The treadmill 7 operates substantially in the same way as that of the treadmill 1 of the first embodiment but differs in structure in the following aspects:

As best illustrated in FIG. 10, each post 31' has a pivot nose 311' which is integrally fixed thereto and which is pivotally inserted into a pivot bearing 41'. The pivot bearing 41' is a flat plate and has a mounting section 411' welded to the tread base 10 and a pivot section 412' extending from the mounting section 411'. The pivot nose 311' is pivotally attached to the pivot section 412' of the pivot bearing 41'. The bottom end of the post 31' is provided with an opening 312' beneath the pivot nose 311', and one end of an arc-shaped coupling arm 42' is inserted into the opening 312'. With a bolt or pin 421', the coupling arm 42' is pivoted to the corresponding post 31'.

Unlike the posts 31 of the first embodiment, each post 31' in this embodiment has a third roller 34 to serve as the third foot unit. The first foot unit of the front links 231 in this embodiment includes blocks 233 in place of the first rollers 211 in the first embodiment. With the second rollers 24 and the third rollers 34, the folded treadmill 7 can be moved easily from one place to another without the need to tilt the treadmill 7.

A third preferred embodiment of the present invention is shown in FIGS. 11 to 16, where like elements are represented by like numerals. The treadmill 8 of the third embodiment includes a tread base 10, a pair of front links 231 with blocks 233 serving as the first foot unit, a pair of rear links 232 with a transverse rod 22 and rollers 24, a pair of posts 31' with third rollers 34, a pair of coupling arms 42', and a lift unit 15. A brake 36 is attached to the bottom end of each post 31' to brake the corresponding third roller 34. A sleeve 35 is disposed around the bottom end of the corresponding post 31' and the post 31' together with the sleeve 35 is pivoted to a corresponding pivot bearing 41' via a pivot 414'. A retention unit 50, which interconnects the tread base 10 and the transverse rod 21 to position the front links 231 relative to the tread base 10, includes an internally threaded tube 51 extending out of the bottom face of the tread base 10 to connect with the transverse rod 21.

Figure 14:
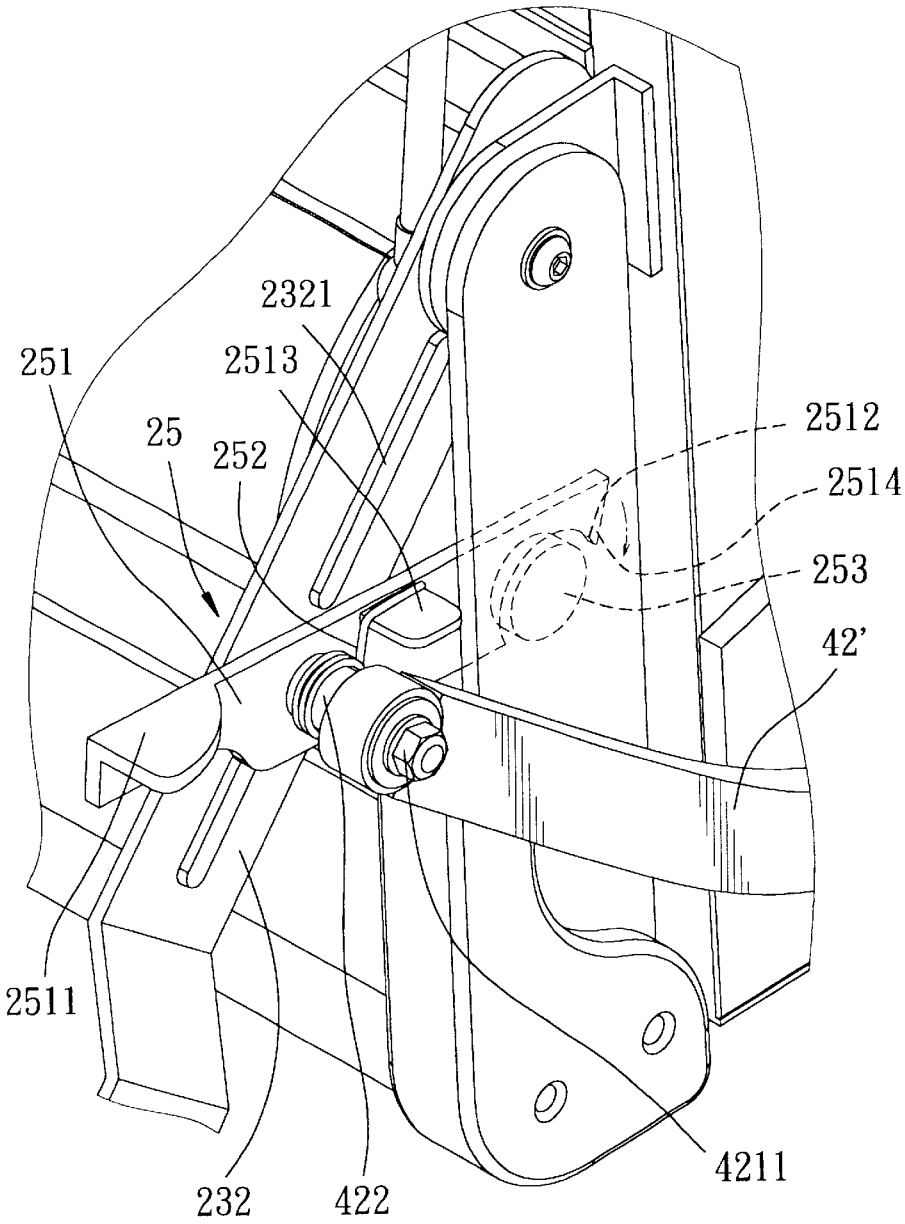
FIG. 14 is a fragmentary perspective view of the treadmill of FIG. 11.
Figure 15:
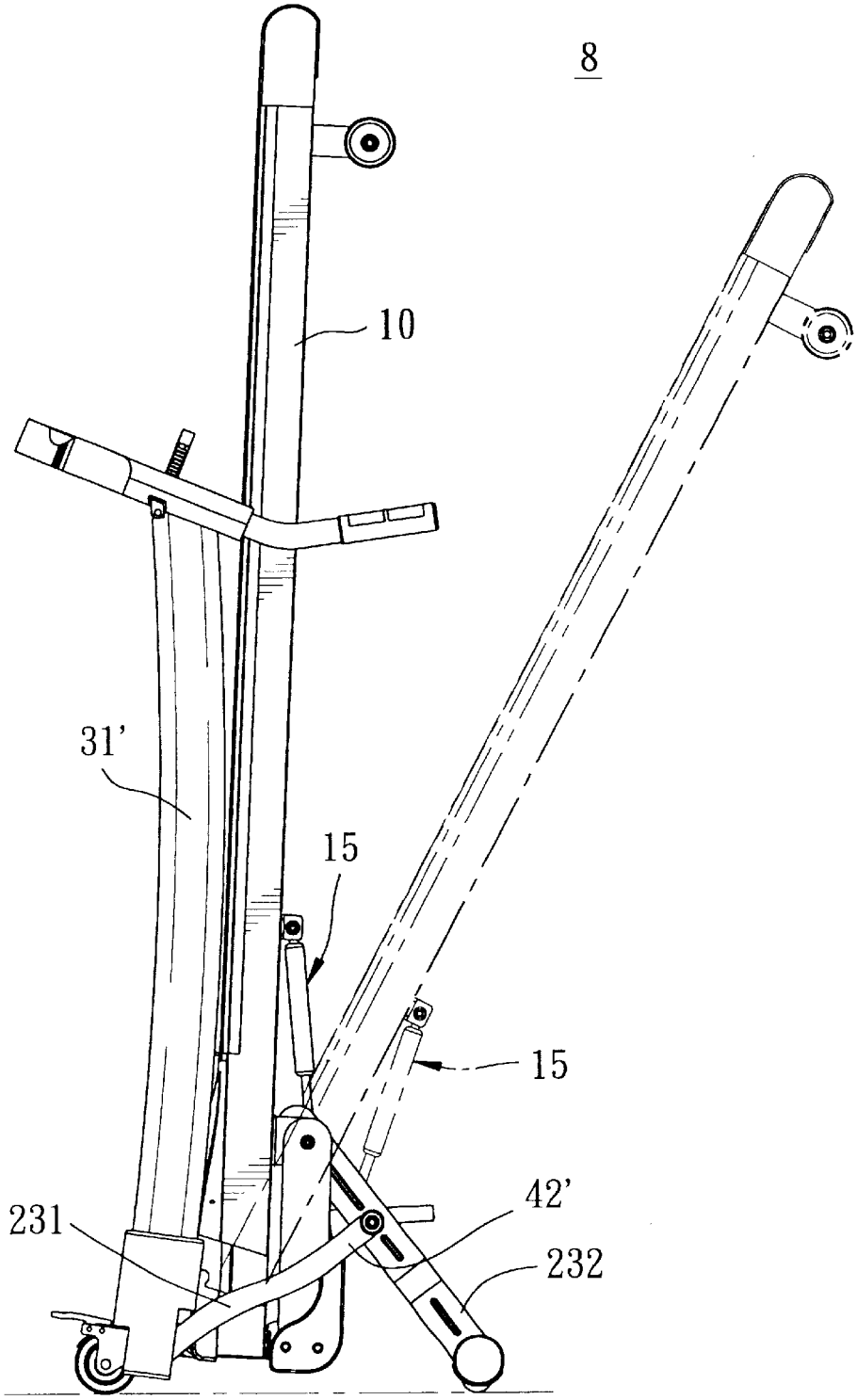
FIG. 15 is a side view of the treadmill of FIG. 11 in the folded position.

Referring to FIG. 14, each rear link 232 is provided with ribs 2321 to enhance the structural strength thereof. A locking unit 25 is provided to lock the rear links 232 against sliding movement relative to the front links 231 or the tread base 10 when the treadmill 8 is at the folded position. The locking unit 25 includes a locking body 251, a torsion spring 252 and a locking knob 253. The locking body 251 has a pressing end 2511, a locking end 2514 with an arcuate cutout 2512, and a supporter 2513 provided between the pressing and locking ends 2511, 2512. The locking body 251 is pivotally connected to the rear link 232 and to the coupling arm 42' through the bolt or pin 422 which interconnects the rear link 232 and the coupling arm 42'. The locking spring 252 is wound around the bolt 422 and has a free end supported by the supporter 2513 of the locking body 251. The locking knob 253 protrudes from the inner side of the front link 231 to the locking end 2512 of the locking body 251.

When the treadmill 8 is at the folded position, the locking end 2512 of the locking body 251 engages the locking knob 253 via the arcuate cutout 2512 of the locking end 2514 to avoid further movement of the rear link 232. When the tread base 10 is to be reoriented into the unfolded position, one presses the locking body 251 at the pressing end 2511 to disengage the locking end 2514 from the locking knob 253, thereby permitting the rear link 232 to slide.

Figure 16:
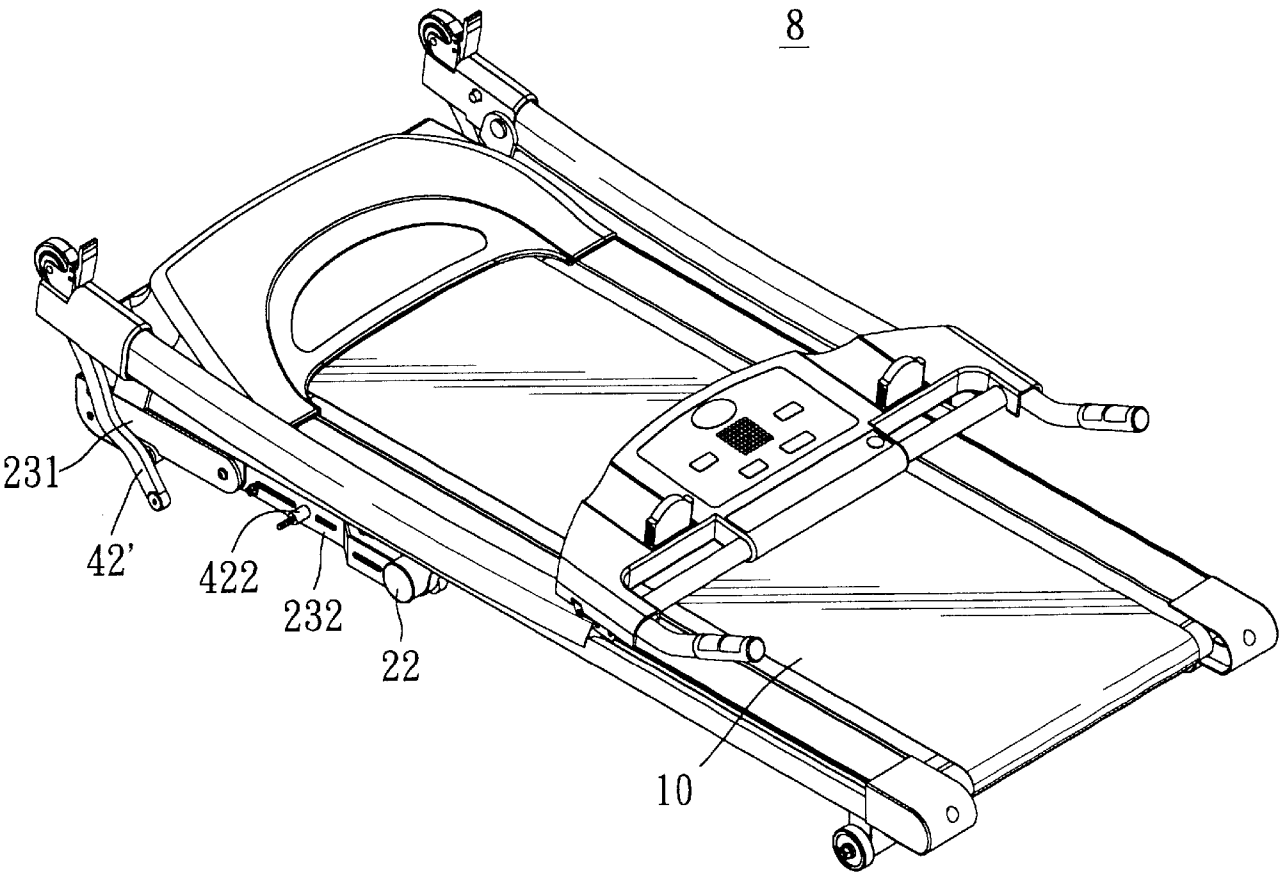
FIG. 16 shows the treadmill of FIG. 11 with the console assembly lying on the tread base for packaging and transport.

The treadmill 8 can be disassembled easily. By loosening the nut 4221, each coupling arm 42' can be detached from the corresponding rear link 232, thereby disconnecting the post 31' from the corresponding rear link 232 as shown in FIG. 16. As such, the console assembly 30 can be folded over the tread base 10 to facilitate packaging and transport.

The treadmill according to the present invention has several advantages as compared with the aforesaid conventional treadmill. Firstly, the treadmill 1, 7 or 8 has a foldable support structure wherein the pivotally interconnected front and rear links 231, 232, which are aligned with each other to lie substantially horizontally below the tread base 10 when the treadmill is the operative position, can move towards each other when the treadmill is folded, thus providing a footprint which occupies a reduced area on the floor surface. The foldable support structure further includes the third foot unit at the bottom of the posts 31 or 31' to share the load of the treadmill 1, 7, or 8 with the front and rear links 231, 232 or with the rear links 232 when the treadmill 1, 7 or 8 is in the folded inoperative position, thereby resulting in a strong and stable support. Secondly, the center of gravity of the tread base 10 can be lowered to a minimum height to enhance stability when the treadmill 1, 7, or 8 is its unfolded operative position. Thirdly, by using the rollers 24, 34 of the second and third embodiments, the treadmill 7 or 8, when placed in the inoperative position, can be moved easily from one place to another. Finally, with the detachable connection between the coupling arms 42' and the rear links 232 in the treadmill 8, the treadmill 8 can be folded to a compact size which facilitates storage or transport.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A treadmill which can be folded to an inoperative position and unfolded to an operative position, comprising:

a tread base having a front end, and a first foot unit disposed at said front end;

a pair of rear links having front ends pivotally connected to said tread base about a first pivot axis posterior to said first foot unit, and rear ends provided with a second foot unit, said rear links being pivotal relative to said tread base to move said second foot unit towards said tread base when the treadmill is at the operative position and away from said tread base when the treadmill is at the inoperative position;

a console assembly including a pair of posts extending upward from said tread base adjacent said front end of said tread base and pivoted to said tread base respectively at left and right sides of said tread base about a second pivot axis, and a console panel attached to top ends of said posts; and a pair of coupling arms having front ends respectively connected to said posts and rear ends respectively connected to said rear links between said front and rear ends of said rear links.

2. The treadmill according to claim 1, wherein said second pivot axis is located above said tread base when the treadmill is at the operative position, said posts having bottom ends provided with a third foot unit, said third foot unit extending at said left and right sides of said tread base to a level lower than said second pivot axis and higher than said first foot unit when the treadmill is at the operative position.

3. The treadmill according to claim 2, further comprising a pair of pivot bearings which have mounting sections fixed to said tread base, and pivot sections extending upward from said mounting sections when the treadmill is at the operative position, said second pivot axis passing through said pivot sections above said tread base.

4. The treadmill according to claim 2, wherein said tread base further includes a pair of pivot supports which project downward from said tread base at said left and right sides of said tread base, said front ends of said rear links being respectively pivoted to said pivot supports.

5. The treadmill according to claim 4, wherein said first foot unit includes a pair of front links having rear ends respectively and pivotally connected to said pivot supports about said first pivot axis, said front links extending forwardly from said first pivot axis and further having front ends formed with foot bottoms adapted to contact a support surface for placement of the treadmill, said front links being pivotal relative to said tread base so as to move towards and away from said tread base.

6. The treadmill according to claim 5, further comprising a retention unit interconnecting said tread base and said front links, said retention unit being extendible to move said front links away from said tread base and retractable to move said front links toward said tread base.

7. The treadmill according to claim 6, wherein said retention unit includes an internally threaded tube, a threaded rod inserted into said tube, and a drive unit to drive said rod to move into or out of said tube.

8. The treadmill according to claim 7, further comprising a locking unit disposed between said front and rear links for locking relative movement between said front and rear links when the treadmill is at the inoperative position.

9. The treadmill according to claim 2, wherein said coupling arms are connected detachably to said rear links.

10. The treadmill according to claim 2, further comprising lift unit which interconnects said tread base and said rear links, said lift unit being extendible to move said rear links away from said tread base and retractable to move said rear links toward said tread base.

* * * * *